US006733864B1

(12) United States Patent
Kubota

(10) Patent No.: US 6,733,864 B1
(45) Date of Patent: May 11, 2004

(54) PROCESSING RELEASE PAPER

(75) Inventor: Takeshi Kubota, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 132 days.

(21) Appl. No.: 09/856,033

(22) PCT Filed: Sep. 14, 2000

(86) PCT No.: PCT/JP00/06325

§ 371 (c)(1),
(2), (4) Date: May 16, 2001

(87) PCT Pub. No.: WO01/20073

PCT Pub. Date: Sep. 14, 2000

(30) Foreign Application Priority Data

Sep. 16, 1999 (JP) ..... P11-261714
Oct. 28, 1999 (JP) ..... P11-306229

(51) Int. Cl.[7] ..... B32B 3/30
(52) U.S. Cl. ..... 428/151; 428/141; 428/156; 428/904
(58) Field of Search ..... 428/141, 156, 428/904, 151

(56) References Cited

U.S. PATENT DOCUMENTS 1,643,400 A * 9/1927 Wilson ..... 428/162
3,663,349 A * 5/1972 Venturino ..... 428/179
4,539,056 A 9/1985 Takeshita et al.
5,151,240 A * 9/1992 Asano et al. ..... 264/284
5,252,379 A * 10/1993 Kuribayashi et al. ..... 428/141
5,393,600 A 2/1995 Omura et al.
5,688,156 A * 11/1997 Hildebrandt et al. ..... 442/180
5,807,621 A * 9/1998 Kite et al. ..... 428/151
6,423,165 B1 * 7/2002 Hishinuma ..... 156/85

FOREIGN PATENT DOCUMENTS

| | | |
|---|---|---|
| DE | 2451809 | 5/1976 |
| EP | 0276048 | 7/1988 |
| EP | 0769588 | 4/1997 |
| JP | 58144187 | 8/1983 |
| JP | 1025668 | 1/1998 |

* cited by examiner

*Primary Examiner*—William P. Watkins, III
(74) *Attorney, Agent, or Firm*—Ladas & Parry

(57) ABSTRACT

The present invention provides separate paper for a process which is to be used for producing synthetic leather and which is capable of preventing inclusion of bubbles generated at the time of application of a coating liquid for forming leather therein and providing normal patterns free from bubbles. In order to achieve the purposes, the present invention provides separate paper for a process comprising a substrate and a separate layer formed in at least one side of the substrate, wherein a surface of the separate layer has polygonal shaped figures which are as a combination thereof a surface view of a repeated hills-and-valleys pattern of the separate layer, and at least one side of each polygon is set so as to be at an acute angle to the direction of applying a synthetic resin paste for forming synthetic leather on the separate layer; the paper wherein a surface of the separate layer has a combination of closed-outline figures which is a view of a repeated hills-and-valleys pattern, wherein a curved-line portion of the closed-outline figure is an out-curved convex curve and crosses the application direction of the synthetic resin paste for forming synthetic leather on the separate layer, and the paper wherein the side faces of the valley part of the pattern on the separate layer are at an angle of 30 degrees or higher to the perpendicular line of the substrate.

16 Claims, 13 Drawing Sheets

PROCESSING RELEASE PAPER

FIELD OF THE INVENTION

The present invention relates to separate paper for a process and more particularly to separate paper having a release agent layer to be used in production of synthetic leather, hereinafter sometimes referred as to syn. leather.

BACKGROUND OF INVENTION

Synthetic leather which has conventionally been produced includes polyurethane leather, semi-synthetic leather, poly(vinyl chloride) leather, and the like. Production of the polyurethane leather comprises steps of coating, drying and solidifying a synthetic resin, such as polyurethane or the like, in a paste state on a separate paper for a process and then laminating the solidified synthetic resin layer to a substrate cloth, if necessary, through an adhesive.

Further, known as a production method for the semi-synthetic leather is a method comprising steps of coating, drying and solidifying a polyurethane in a paste state on a separate paper for a process, then forming a foamed layer made of poly(vinyl chloride) or the like onto the solidified polyurethane, and after that, laminating the solidified synthetic resin layer to a substrate cloth, if necessary, through an adhesive.

As a production method for the poly(vinyl chloride) leather, a method applicable comprises steps of coating, heating and gelling a poly(vinyl chloride) sol on separate paper and then laminating the resultant foamed layer of the poly(vinyl chloride) on a substrate cloth, if necessary, through an adhesive.

An example of the conventional separate paper is, in case of employing it for polyurethane laser production, a separate paper (polypropylene type) for a process which comprises a substrate and a separate layer formed on the substrate by applying polypropylene in a thickness of 20 to 50 $\mu$m.

Further, in case of producing the semi-synthetic leather or the poly(vinyl chloride) leather, available is a separate paper (a methylpentene-based resin type) for a process which comprises a substrate and a separate layer which is a single layer of a methylpentene-based resin in a thickness of 20 to 50 $\mu$m formed on the substrate.

Further, also used is a separate paper (acrylic resin type) for a process which comprises a substrate and a separate layer formed by applying an acrylic resin in 20 to 120 $\mu$m to the substrate.

The separate papers generally used in the prior arts are formed so as to have a variety of hills-and-valleys patterns by embossing them after formation of the aforementioned polypropylene, methylpentene-based resin or acrylic resin layer onto a substrate, or by in-line embossing them in the state that the resins are not completely solidified.

After that, a synthetic resin paste (hereinafter referred as to a resin paste) for synthetic leather is applied, dried, and solidified so as to fill the valley parts of the hills-and-valleys pattern formed on the separate paper with the paste, and then the obtained layer article is laminated on a substrate cloth.

In general, the resin paste to be used has a high viscosity. Thus, it is difficult to fill completely the valley parts of the pattern on the separate paper with the resin paste.

In order to prevent the air from entrapping in the valley parts, some techniques has been developed in the art, for example, that of using a furnisher roll for coating parts, or of lowering the viscosity of the resin paste to be used.

However, only by such techniques, it is difficult to lessen the air-entrapping due to the configuration of the hills-and-valleys pattern.

SUMMARY OF INVENTION

The present invention has been developed in consideration of the above described situations and aims to provide separate paper for a process which prevents the air-entrapping between the separate paper and a resin paste to be applied at the time of producing synthetic leather and which is capable of producing synthetic leather precisely regenerating the desired normal pattern free from bubbles of undesirably entrapped gas.

In order to achieve the above mentioned purposes, the present invention provides separate paper or a process comprising a substrate and a separate layer formed in at least one side of the substrate, wherein a surface of the separate layer has polygonal shaped figures which are as a combination thereof a surface view of a repeated hills-and-valleys pattern of the separate layer, and at least one side of each polygon is set so as to be at an acute angle to the direction of applying a synthetic resin paste for forming synthetic leather on the separate layer.

In such separate paper, if the polygonal shaped figures which are as the combination thereof a surface view of the repeated hills-and-valleys pattern of the separate layer are (2+2n)-gonal shaped figures (wherein the reference character n denotes a natural number), it is preferable that at least one diagonal line of each polygon is parallel to the application direction of the synthetic resin paste for forming synthetic leather on the separate layer. On the other hand, if polygonal shaped figures which are a combination thereof a surface view of the repeated hills-and-valleys pattern of the separate layer are (1+2n)-gonal shaped figures (wherein the reference character n denotes a natural number) and each possesses an axial symmetry with the symmetric axis which has an apex of the polygon, it is preferable that the symmetric axis is parallel to the application direction of the synthetic resin paste for forming synthetic leather on the separate layer and the apex is positioned at the application starting-side in the polygon. Further, the separate layer may have a combination of the aforesaid two types of polygon shaped figures.

The present invention also provides separate paper for a process, comprising a substrate and a separate layer formed in at least one side of the substrate, wherein a surface of the separate layer has a combination of closed-outline figures which is a view of a repeated hills-and-valleys pattern, wherein a curved-line portion of the closed-outline figure is an out-curved convex curve and crosses the application direction of the synthetic resin paste for forming synthetic leather on the separate layer.

Further, the present invention provides separate paper for a process comprising a substrate and a separate layer formed in at least one side of the substrate, wherein the side faces of the valley part of the pattern on the separate layer are at an angle of 30 degrees or higher to the perpendicular line of the substrate.

Further, the present invention provides separate paper for a process comprising a substrate and a separate layer formed in at least one side of the substrate, wherein the side faces of the valley part forming the figure on the separate layer are at an angle of 0 degrees or higher to the perpendicular line of the substrate and wherein the crossing portions of the side faces and a bottom face in the valley part are radiused. In this case, the radiused portions preferably have 50 $\mu$m or longer radius.

Also, in the separate paper for a process of the present invention, the plane portions of the surface of the separate layer are preferably a finely roughened face having an arithmetical mean roughness Ra of 1.5 to 30.0 μm. Further, in this case the figures, i.e., the surface hills-and-valleys pattern of the separate layer preferably have a Ry of 10.0 to 100.0 μm.

DETAILED DESCRIPTION

Hereinafter, separate paper for a process according to the present invention will be described. The separate paper for a process according to the present invention can be classified in mainly three embodiments. Hereinafter, the separate paper for a process will be described for each embodiment.

1. First Embodiment

Figure 1A:
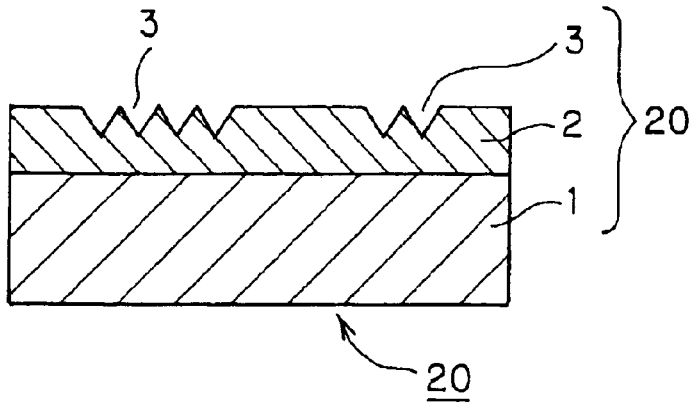
FIG. 1(A) is a diagrammatic sectional view of the separate paper for a process of a first embodiment according to the present invention.
Figure 1B:
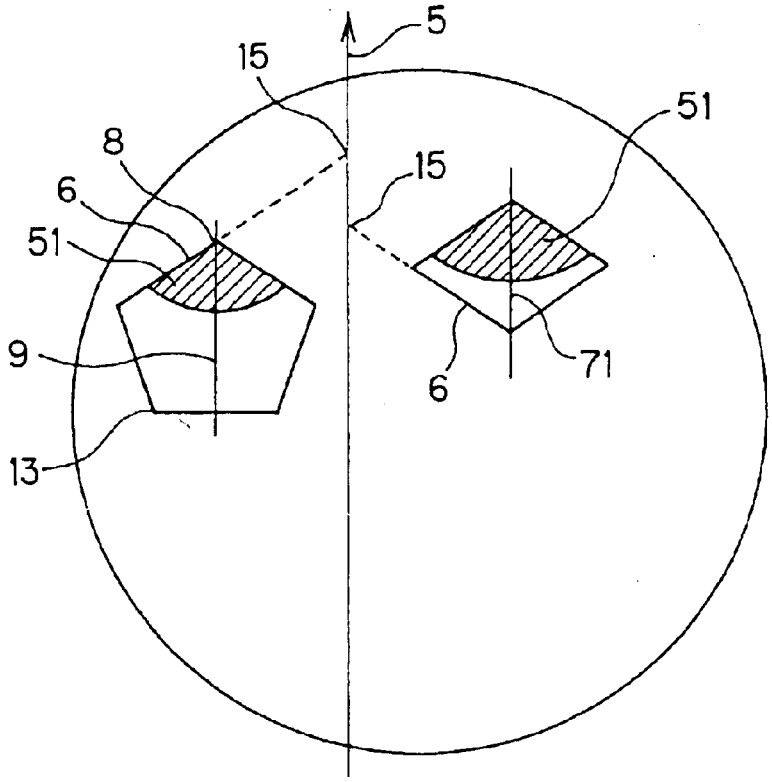
FIG. 1(B) is a schematic plan view showing a formation position of polygons on the separate paper for a process.
Figure 2:
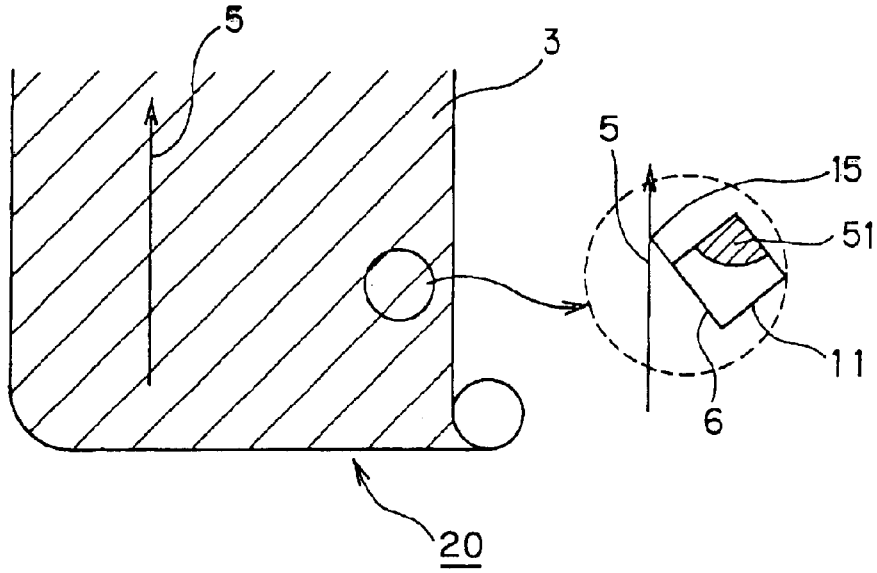
FIG. 2 is a schematic view showing a formation position of a regular square on the separate paper for a process of the first embodiment.
Figure 3:
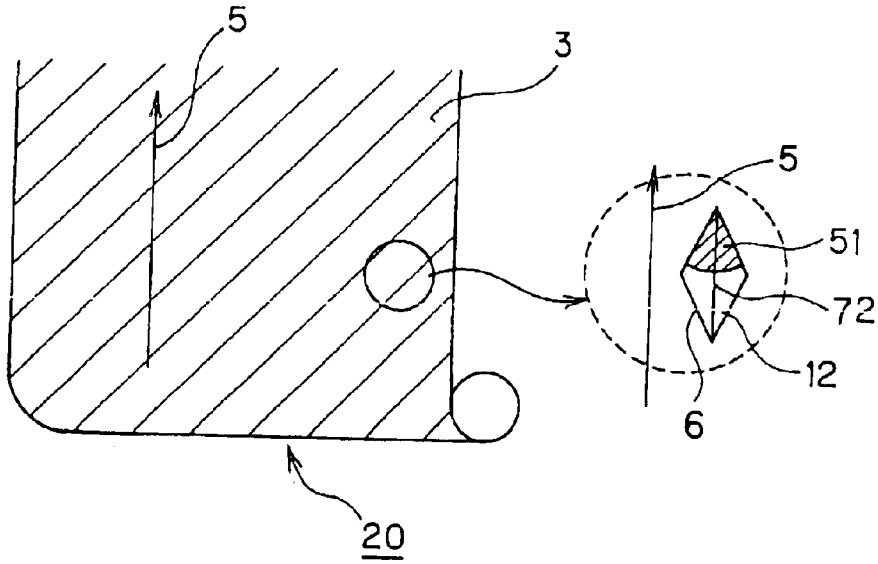
FIG. 3 is a schematic view showing a formation position of another figure (a diamond figure) on the separate paper for a process of the first embodiment.

As shown in FIG. 1, FIG. 2 and FIG. 3, the separate paper of the first embodiment of the present invention is separate paper 20 comprising a substrate 1 and a separate layer 2 formed in at least one side of the substrate, wherein a surface thereof has a combination of polygonal shaped figures which is a view of a repeated hills-and-valleys pattern 3, and wherein one sides 6 of the polygons are set so as to cross at crossing points 15 with an acute angle to the direction 5 of applying a synthetic resin paste 51 for forming synthetic leather on the separate layer 2.

The separate paper 20 is also characterized in that the combination of the polygons which is a view of the repeated hills-and-valleys patterns 3 on the surface of the separate layer 2 is adjusted so as to keep at least one diagonal line 71 or 72 be parallel to the application direction 5 of the resin paste 51, when the polygons are those having an even number of apexes such as a regular square 11 or a diamond shape 12 as shown in FIG. 2 and FIG. 3.

Figure 4:
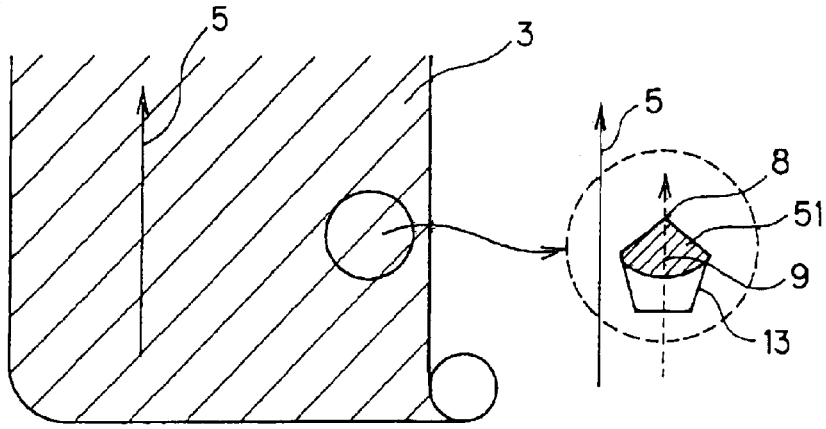
FIG. 4 is a schematic view showing a formation position of still another figure (a pentagon) on the separate paper for a process of the first embodiment.
Figure 5:
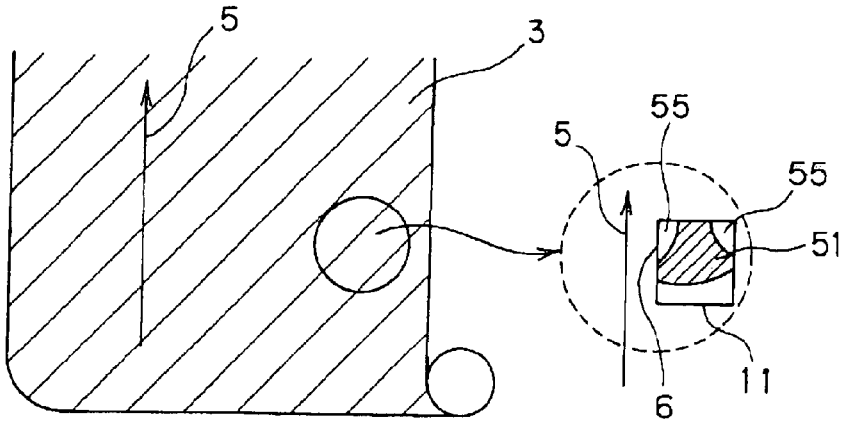
FIG. 5 is a schematic view showing a formation position of a rectangular figure of a comparative example.

Alternatively, the separate paper 20 of the first embodiment is characterized in that the combination of the polygons which is a view of the repeated hills-and-valleys patterns 3 on the surface of the separate layer 2 are adjusted so that each of polygons possesses an axially symmetry with a symmetric axis 9 which contains an apex 8 of the polygon, and wherein the axis 9 is parallel and reverse (the apex of polygon is positioned at the application starting point in the polygon) to the application direction 5 of the resin paste 51, when the polygons are those having an odd number of apexes as shown in FIG. 4.

Further, the separate paper of the first embodiment may be a separate paper characterized by comprising the separate layer which has a combination of the aforementioned polygons having an even number of apexes and the aforementioned polygons having an odd number of apexes.

In such separate paper which has the separate layer having the surface hills-and-valleys pattern which is a repeated pattern and of which surface appearance is a combination of polygonal figures, if one side of the polygon is at crossing points at an acute angle to the application direction of the resin paste in accordance with the present invention, inclusion of bubbles rarely takes place when the resin paste is applied. In contrast with that, if sides of polygons, more particularly, sides located at the application starting-side, are at right angles to the application direction of the resin paste, the resin paste does rather not flow to the corner portions of both ends of the sides to leave the un-filled portions where the resin paste does not flow into as to be bubbles and the patterns of these parts are precisely not to be regenerated.

Further, as for limited use purposes, even if it is desired to form a product having figures in which one side of each polygons is at right angles to the application direction of the resin paste, the product can be prepared by using the separate paper which has the same figures but being rotated in their arrangement so as to locate one side of each polygons at an acute angle to the flow direction.

That is because, synthetic leather is generally produced by applying the resin paste to separate paper with width of 1000 to 1800 mm and consequently in case that what is desired is the figures in which one side of each polygon is at right angles to the application direction of the resin paste , the restriction of figures in arrangement can completely be eliminated depending on the sizes of the secondarily processed products of the obtained synthetic leather, by rotating the figures at an acute angle to the application direction of the resin paste on the past application.

On the other hand, in case that the separate paper has the separate layer with the surface hills-and-valleys pattern which is a repeated pattern and of which surface appearance is a combination of polygons having an odd number of apexes, by arranging each polygons so as to be axially symmetry with a symmetric axis which contains an apex 8 of the polygon and which is parallel to the application direction 5 of the resin paste 51, and locating the apex 8 on the releasing side of a roll of separate paper (on the starting-side of the resin paste application), as shown in FIG. 4, the probability of occurrence of the bubble inclusion at both ends of the sides can be suppressed and the patterns of these parts can precisely be regenerated.

Further, on the basis of above aspects, in the separate paper which has the separate layer having the surface hills-and-valleys patterns of which surface appearance is a combinations of polygons, it is possible to construct patterns having the variety of figure patterns and the prevention of bubble inclusion phenomenon, by combining various figures as far as one side of each polygon, wherein the side is located at the application starting-side of each polygon, keeps away from being at right angles to the transferring direction of the separate paper(the application direction of the resin paste).

The length of one side of each polygon is preferably controlled to be 50 to 500 $\mu$m. If the length is shorter than 50 $\mu$m, each valley part is not filled up to every corner with the resin paste at the time of application of the resin paste, and which results in uneven coating. On the other hand, if longer than 500 $\mu$m, the resin paste comes out the valley parts to make it impossible to form uniform hills-and-valleys pattern.

Further, formation of a slight radius (R) in the tip of the interior angle of each polygon is preferable in a common technique and it is also preferable to insert a working step of washing the tip of the interior angle.

Materials for the substrate to be used in the present invention are selected from those which have not only a high heat resistance and strength to stand the application of the separable resin layer and the process of forming the hills-and-valleys patterns but also a sufficient heat resistance and chemical resistance as process paper for application and formation of synthetic leather.

The substrates usable includes papers such as Kraft paper, woodfree paper and the like; polyamides such as 6-nylon, 6,6-nylon and the like; polyesters such as polyethylene terephthalate, polybutylene terephthalate, and the like; and other plastic films such as polypropylene; metal foils; woven fabric; unwoven fabric, synthetic papers; and their laminated bodies. In terms of suitability for processing synthetic leather and also heat resistance, paper made from natural pulp is preferable to be used. The thickness of the substrate is set as to make it possible to form a hills-and-valleys pattern, or a plane surface pattern on the surface of the separate layer, which formation will be described somewhere later, in consideration of the material to be employed. The thickness is preferable to be set within a range of 50 to 200 $\mu$m.

As the main raw material for paper, a typical example of the substrate, the following composition are available. Pulp such as L-BKP, N-BKP of broadleaf trees and needle-leaf trees is used as a main material and optionally, broke which is broke out in the process and wastepaper are properly mixed with the pulp. Examples to be used as additives, inclusively added sizing agents such as a rosin emulsion; defoaming agents such as a cationic starch, aliphatic acid esters or special paraffins; aluminum sulfate, and the like are cited. Alternatively, in size press process, a surface sizing agent such as corn starch, a styrenic resin and the like, may be added and a size press solution may be applied to raw paper.

The face of the substrate on which the separate layer will be formed may be subjected to heating or corona discharge treatment in order to make the adhesiveness between the substrate and the separate layer firm and stable, in advance of the formation of the separate layer.

For the separate layer, the following resins are usable: well-known thermoplastic resins and reaction curable resins such as an acrylic resin, polyethylene, polypropylene, polymethylpentene, a silicone type resin, an alkid type resin including aminoalkid and the like. Methods applicable for curing methods of resins include a thermosetting method and methods for curing resins by ultraviolet rays, or ionization radiations such as electron beams and the like. The resin of the separate layer can be selected in consideration of the peel-off property in relation to the resin to be used for forming the synthetic leather.

The separate layer can be formed by applying the resin as mentioned to the substrate by a well-known method, such as roll coating, gravure coating, extrusion coating, knife coating, smear bar coating, and dip coating, by laminating a resin film via an adhesive layer or by applying a thermally melted resin. Further, the separate layer may be formed in a multilayer in consideration of the separation property in relation to the synthetic leather, the material cost, and the easiness and difficulty of the processing of the used materials.

The thickness of the separate layer may be about 3 to 100 $\mu$m, preferably, about 4 to 60 $\mu$m. If the thickness is thinner than 3 $\mu$m, the peel-off property of the synthetic leather and the separate layer formed by applying and forming a resin paste is deteriorated. On the other hand, if thicker than 100 $\mu$m, the separate paper is considerable curled and the depth of the valley parts in the present invention hardly exceeds 60 $\mu$m, so that the resin used practically for the separate layer would be wasted except a specific case.

The separate paper having a plane surface can be used as a product while being coated with the resin paste and in case of separate paper having figures in the surface, the following embossing process is carried out.

That is, embossing is carried out using an embossing apparatus comprising an emboss roll having repeated hills-and-valleys pattern, and a paper roll or metal roll receiving the hills-and-valleys pastern, or a metal roll which has a surface hills-and-valleys pattern which is to be fitted with that of the emboss roll. That is, the separate layer is so set as to be brought into contact with the emboss roll and the emboss roll is heated and pressurized to form separate paper having the hills-and-valleys pattern transferred.

Although depending on the material of the separate layer, the heating temperature is preferably 80 to 150° C. and the pressure is preferably 40 to 100 kg/cm.

Further, in case of employing a flat emboss plate other than a roll press, the separate paper can be formed by a flat press.

Attributed to the complicated arrangements, such as combinations of polygons, of the hills-and-valleys pattern at that time, bubbles may be involved at the time of application of the resin paste.

In the separate paper which has the separate layer having the surface hills-and-valleys patterns of which surface appearance is a combinations of polygons, it is possible to reduce the bubble inclusion at the step of producing synthetic leather, by arranging one side of each polygon to be at acute angle to the application direction of the resin paste(not at right angle). Because, in such construction, at first coming of the resin paste from the plane part of the pattern to the valley part, the apex portion of the polygon at the valley part can be filled with the resin paste.

Polygonal shapes may be selected from any polygons, for example, triangles such as a regular triangle, an isosceles triangle and the like; rectangles such as a regular square, a diamond shape, a parallelogram and the like; pentagons such as a regular pentagon; hexagons such as a regular hexagon; heptagons such as a regular heptagon; octagons such as a regular octagon and the like.

In the separate paper which has a repeated pattern of a combination of polygons each having an even number of apexes, what is effective to prevent inclusion of bubbles is to adjust at least one diagonal line of each polygon so as to be parallel to the application direction of the resin paste to be applied to the separate paper or to position one side of each polygon so as to cross at an acute angle to the application direction.

The shapes of the polygons can be selected from any polygons with an even number of apexes for example rectangles such as a regular square, a diamond, a parallelogram, a hexagon such as a regular hexagon, an octagon such as a regular octagon and the like.

In the separate paper which has a repeated pattern of a combinations of polygons each having an odd number of apexes, what is effective to prevent inclusion of bubbles is to arrange each polygon so as to be axially symmetry with a symmetric axis which contains an apex of the polygon and which is parallel to the application direction, and locate the apex on the starting-side of the resin paste application. The shapes of the polygons can be selected from any polygons with an odd number of apexes for example for example, a triangle such as a regular triangle; an isosceles triangle and the like; a pentagon such as a regular; a heptagon such as a regular heptagon and the like.

Even if the repeated figures to be formed on the separate layer of the separate paper has a combination of various polygons rather than combination of monotypic polygons, inclusion of bubbles at the time of producing synthetic leather can be suppressed as far as the polygons satisfy the above described conditions.

In case of producing synthetic leather using the separate paper produced in the above described manner, a resin paste is applied and dried in the separate layer side, a substrate cloth is laminated on the paste-coated side as an adhesive face, the paste is further dried, aged, and, at last, separated from the separate layer to obtain synthetic leather having a repeated hills-and-valleys pattern with uniformity.

2. Second Embodiment

Next, the second embodiment of the present invention will be explained.

Figure 7A:
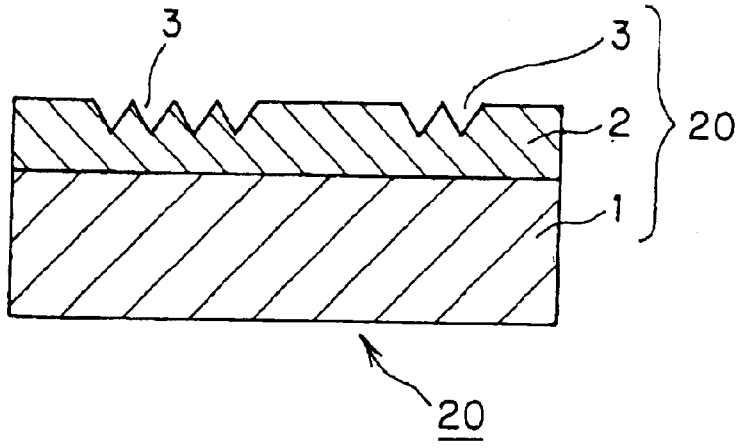
FIG. 7(A) is a diagrammatic sectional view of separate paper for a process of a second embodiment according to the present invention and FIG. 7(B) is a schematic plan view showing a formation position of the figures on the separate paper for a process.

As shown in FIG. 7, the separate paper of the second embodiment according to the present invention is a separate paper 20 comprising a substrate 1 and a separate layer 2 formed in at least one side of the substrate as same as that of the first embodiment, wherein a surface of the separate layer 2 has a combination of closed-outline FIG. 4 which is a view of a repeated hills-and-valleys patterns 3, and wherein a curved-line portion 18 of each closed-outline figure is an out-curved convex curve and crosses the application direction 5 of the resin paste 51 to be applied to the separate layer.

Figure 8:
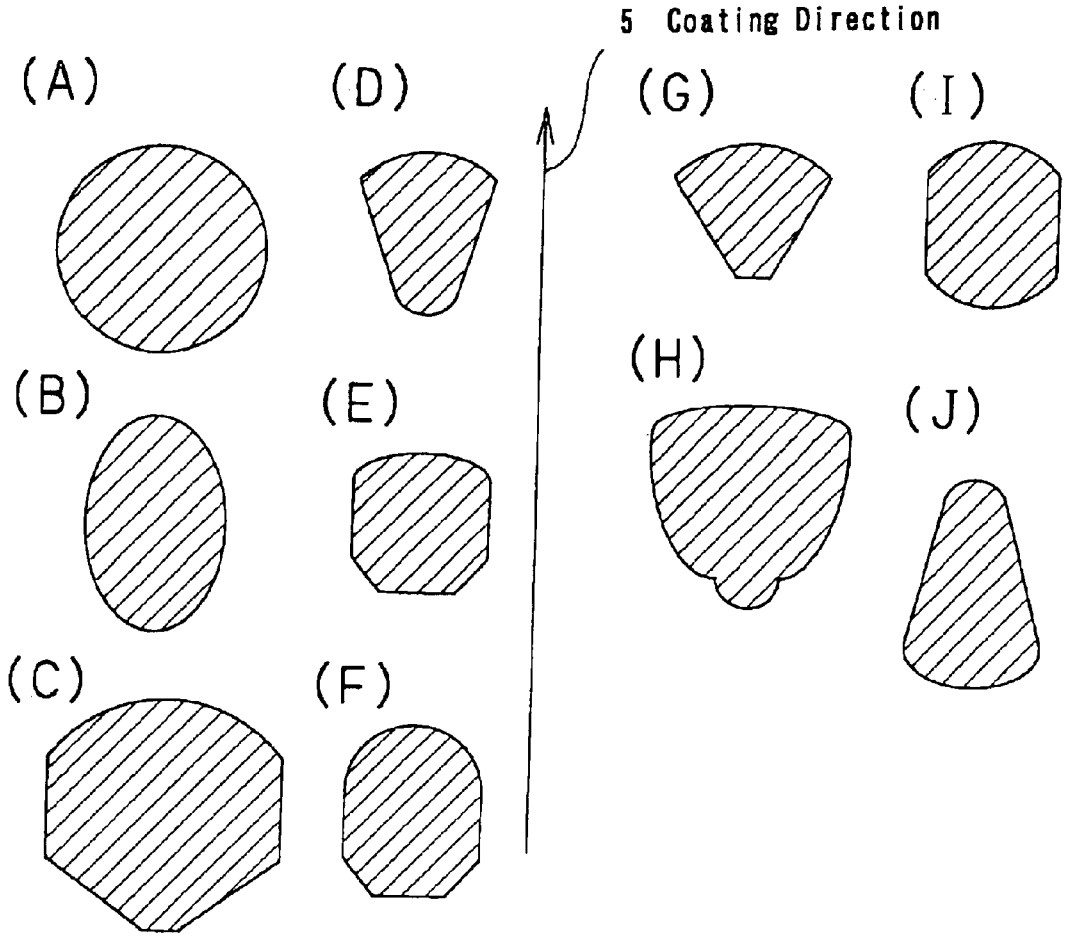
FIGS. 8(A) to 8(J) are diagrammatic sectional views showing other closed-outline figures of the second embodiment.

The curved-line portions of the closed-outline figures do not belong only in circular and elliptical shapes but also in polygons which have those as replacements for some portions of straight lines so as to be curved outwardly to cross the application direction as shown in FIG. 8.

Figure 10:
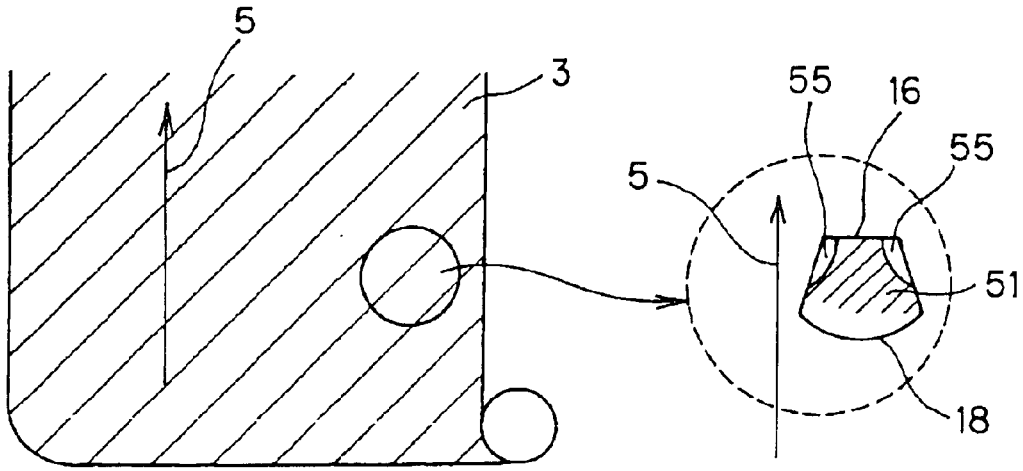
FIG. 10 is a schematic view showing the filling state at the time of applying a resin paste to the separate paper for a process of the comparative example.

In conventional separate paper which has the separate layer, wherein the separate layer has a hills-and-valleys repeated pattern of which surface appearance is a combination of polygons, since one sides of polygons are so disposed as shown in FIG. 10 as to keep straight line portions 16 at positions at right angles to the application direction 5 of the resin paste, inclusion of bubbles 55 takes place at the step of application of the resin paste. Namely, since the side 16 located at the application starting-side for forming the patterns is at right angles to the application direction 5 of the resin paste, the resin paste can not flow into the corners of both ends of the side to leave un-filled portions and which is followed by trapping bubbles 55 in the portions, and the patterns of these portions are hence precisely not to be regenerated.

The length of one side of each closed-outline figure is preferably 50 to 500 $\mu$m. If the length is shorter than 50 $\mu$m, each valley part is not filled up to every corner with the resin paste at the time of applying the resin paste, and which results in uneven coatings If longer than 500 $\mu$m, the resin paste overflows the valley parts to make it impossible to form uniform hills-and-valleys pattern.

Further, in case that the closed-outline figure has a interior angle formed by crossing straight line portions therein, a slight radius (R) may be formed in the tip of the interior angle as a common technique and a washing of the interior angle tip parts is preferable to be carried out in terms of the production process.

When the surface hills-and-valleys pattern of the separate layer in the present invention has as the surface appearance a combination of circular and/or elliptical figures, and the portion of each figure, with which the resin paste is to be brought into contact at first among all portions in the figure, is a out-curved convex curve, the probability of involving bubbles at both ends thereof is lowered and which is followed by lessening the inclusion of the bubbles. Further, in case that the closed-outline figure is composed of elliptical, oval-shaped, or gourd-shaped curve, it is needless to say that they are preferably set as to keep the minor axis thereof crossing the application direction.

The materials for the substrate and the separate layer, the formation method, the adhesion method, the thickness and the like for the present embodiment are similar to those as the first embodiment, so that their description is eliminated.

Also, the separate paper of the present embodiment is to be subjected to the embossing process as same in the first embodiment and at that time, owing to having the specific patterns such as combinations of closed-outline figures including the curves as the surface appearance of the hills-and-valleys pattern in accordance with the present embodiment, inclusion of bubbles can be prevented at the step of applying the resin paste.

Figure 9:
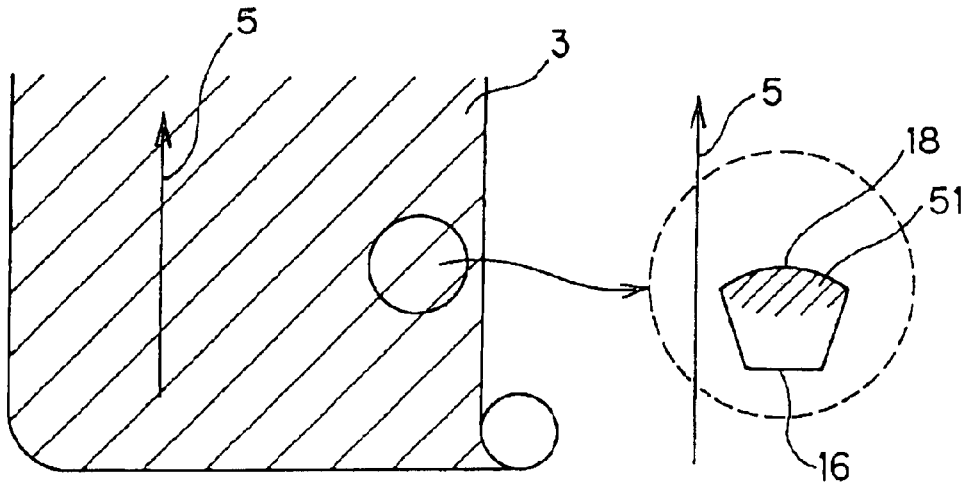
FIG. 9 is a schematic view showing the filling state at the time of applying a resin paste to the separate paper for a process of the second embodiment.

In the separate paper which has the separate layer, wherein the separate layer has the surface hills-and-valleys pattern of which surface appearance is a combination of the closed-outline figures each having curved-line, as shown in FIG. 9, at least the out-curved convex curve portions 18 of the closed-outline figures are set as to cross the application direction 5 of the resin paste 51 (to encounter the flow direction of the resin paste) is effective to suppress inclusion of bubbles at the step of applying the resin paste in the production of synthetic leather.

The shapes of the closed-outline figures may be those which are at first selected from any polygons for example triangles such as a regular triangle and an isosceles triangle; rectangles such as a regular square, a diamond shape, and a parallelogram; pentagons such as a regular pentagon; hexagons such as a regular hexagon; heptagons such as a regular heptagon; octagons such as a regular octagon and the like and then deformed by replacing line(s) at one or two sides of the polygons with out-curved convex curve(s) and setting them so as to cross the resin paste application direction.

It is needless to say that the polygons are not at all necessary to be regular polygons with same length's sides but may have any lengths for individual sides.

Also, the same effect can be obtained even when the surface appearance of the hills-and-valleys pattern is a combination of the above mentioned polygonal figures each composed of the straight lines and/or curved lines and figures each composed of curved line such as circular and/or elliptical, or a combination of figures composed of circular and/or elliptical.

When the synthetic leather is produced by using the separate paper embossed as described above, a resin paste is applied and dried in the separate layer side, a substrate cloth is laminated on the paste-coated side as an adhesive face, the paste is further dried, aged, and, at last, separated from the separate layer to obtain synthetic leather having the repeated hills-and-valleys pattern with uniformity.

3. Third Embodiment

Next, the third embodiment of the present invention will be explained.

Figure 11A:
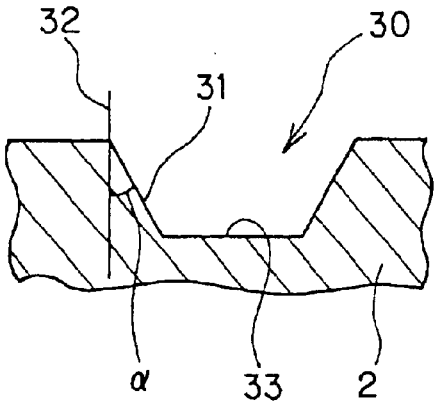
FIG. 11 are diagrammatic sectional views each showing a pattern (valley part) of a third embodiment according to the present invention.

As same as the first embodiment, the separate paper according to the present embodiment comprises a substrate and a separate layer formed in at least one side of the substrate, and FIG. 11(A) illustrates an example of that showing a figure part on the separate layer 2, namely, a valley part 30 in the layer 2 as viewing in a section.

In this embodiment, it is characterized that the parts constructing the individual figures of pattern on the separate layer 2, namely, valley parts 30 formed in the separate layer 2, have side faces 31 at an angle α to a perpendicular line 32 of the substrate not narrower than 30 degrees.

Figure 11B:
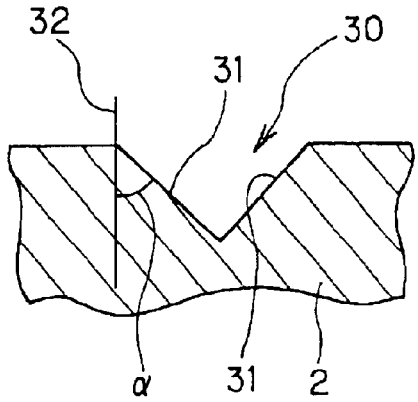

The valley parts 30 in this embodiment may have their respective fiat-bottomed faces 33 as shown in FIG. 11(A) or may be composed of only their respective side faces 31 as shown in FIG. 11(B) having no flat-bottom, that is, notch-shaped parts as the surface figure parts of the separate layer 2.

By controlling the angle α to be not narrower than 30 degrees, the inclusion of bubbles can be avoided.

Figure 12A:
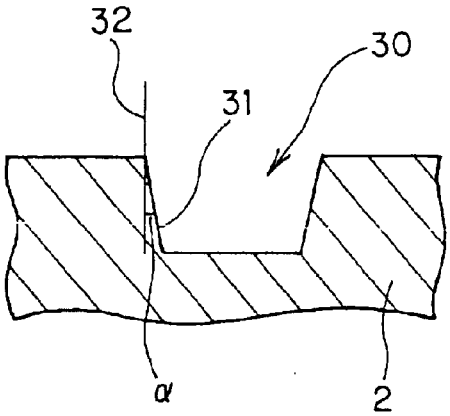
FIG. 12 are diagrammatic sectional views each showing another example of the third embodiment.
Figure 12B:
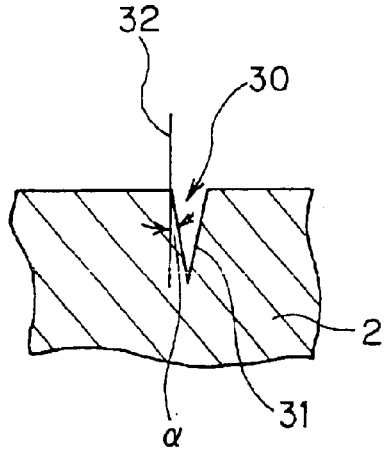

For example, when the angle α is narrower than 30 degrees as shown in FIG. 12(A) and FIG. 12(B), bubble inclusion may take place in the bottom area of the figure part(the valley part 30)of the separate layer at the step of applying the resin paste to the separate paper, and which causes a problem that the pattern and gloss of the separate paper cannot be regenerated precisely on the synthetic leather to be obtained.

Figure 13:
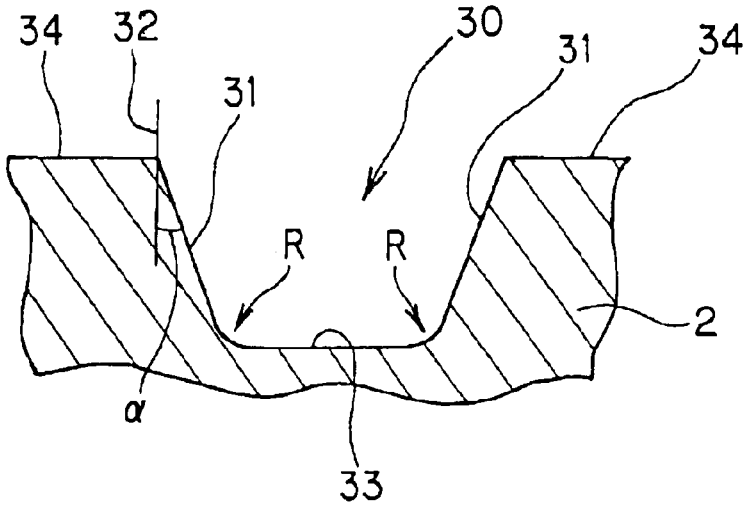
FIG. 13 is a diagrammatic sectional view showing still another example of the third embodiment according to the present invention.

FIG. 13 shows another example of this embodiment. The example is characterized in that the side faces 31 of the valley part 30, wherein the valley part 30 brings along the figure on the separate layer, have the angle α of not narrower than 0 degree to the perpendicular line 32 of the substrate and the crossing portion of the side faces 31 and bottom face 33 in the valley part 30 are radiused. Incidentally, that the side faces 31 of the valley part 30 have the angle of not narrower than 0 degree to the perpendicular line 32 of the substrate means the surface 34 of the separate layer 2 and the side faces 31 of the valley part form obtuse angles.

Further, in the case that the side faces 31 of the valley part 30 have the angle α of not narrower than 0 degree to the perpendicular line 32 of the substrate, that is, the side faces 31 are from perpendicular to parallel to the substrate 2 of the separate paper, when radiused portions are formed at the crossing points of the side faces 31 and the bottom faces 33 in the valley parts 30 of the separate paper, the phenomena of bubble inclusion can be are lessened. Although it depends on the size of the figure, if radiused portion has a radius of 50 μm or longer, no bubble inclusion would takes place.

Incidentally, also in this case, the valley parts may be notch-shaped with no flat-bottom. If they have no flat-bottom, the crossing point of both side faces would be radiused.

The substrate, the materials, the formation methods, the adhesion methods, the thickness and the like for this embodiment are same as those of the first embodiment, the description for them is omitted.

The separate paper of this embodiment may comprise an embossing process as same as the first embodiment and in this case, owing to the specific configuration for the valley parts of the pattern, inclusion of bubbles at the step of applying the resin paste can be prevented.

Using the separate paper produced in the forgoing manner, synthetic leather is produced. A resin composition for forming the surface skin of synthetic leather is applied to the separate layer side of the separate paper and dried, a substrate cloth is stuck to the adhesive face of the resin composition layer, and after being dried and aged, the resin composition is separated from the separate layer to obtain synthetic leather having a hills-and-valleys pattern The resins usable include a polyurethane, poly(vinyl chloride) and the like. In case of a polyurethane, the solid content of the resin composition to be used is preferably 20 to 50%. In case of poly(vinyl chloride), poly(vinyl chloride) is preferable to be used while being mixed and dispersed with a plasticiser such as DOP and DUP, a foaming agent, a stabilizer and the like.

The coating method for the resin for synthetic leather may be a well-known coating method such as a knife coating method, a roll coating method, a gravure coating method and the like.

4. Combinations of the First Embodiment, the Second Embodiment and the Third Embodiment As described above, the first embodiment and the second embodiment have characteristics in the figures in the surface appearance of the embossed pattern , while the third embodiment has characteristics in the configuration in the section of the embossed pattern. Consequently, in the present invention, either the first embodiment or the second embodiment can be combined with the third embodiment and by combining them, further advantageous effects can be obtained with respect to the prevention of bubbles inclusion. Further, in the present invention, the individual figures observed in the plane views, that is, in the surface appearances of the patterns according to the first embodiment and second embodiment may be combined in order to construct any other patterns.

5. Formation of Finely Roughened Faces

In the embodiments, the plane portions in the surface of the separate layer are preferably finely roughened faces with the arithmetical mean roughness Ra of 1.5 to 30.0 μm. Hereinafter, description relevant to that will be given.

The finely roughened face as the plane portion of the surface of the separate layer can be formed by a cooling roll at the time when the thermoplastic resin for forming the separate layer is spread on the substrate sheet by a melt extrusion coating or by a T-dies method.

In the present invention, the finely roughened face is preferable to be adjusted as to have the arithmetical mean roughness Ra of 0.3 to 2.0 μm. If higher than 2.0 μm, the finely roughened face cannot sufficiently be pressed when the surface figures or the hills-and-valleys pattern is formed to the separate layer by using an emboss roll, and thus the finely roughened face 31 formed on the surface of the forming sheet 10 becomes rough than necessary. Consequently, the gloss of the synthetic resin leather to be formed by casting is excessively eliminated.

On the other hand, if smaller than 0.3 μm, the face is almost a smooth face.

Consequently, when the surface figures or the hills-and-valleys pattern is formed to the separate layer by using an emboss roll, even though the pressure is increased so as to make protrude parts of the emboss roll completely reach the separate layer, the gas unfortunately caught between the protrude parts of the emboss roll and the separate layer cannot escape and remains between them. As a result, un-embossed parts would be formed and subsequently there occurs a trouble that the surface figures or hills-and-valleys pattern of the separate layer cannot be formed precisely.

Further, when, onto the surface of the separate layer having the arithmetical mean roughness Ra of 0.3 to 2.0 μm, the surface figures or hills-and-valleys pattern in accordance with the first embodiment, second embodiment, third embodiment or any combinations thereof are formed by using an emboss roll, the biting in relation to the emboss roll does not necessarily depend on the height of the embosses. In other words, those with a high height in figures or hills-and-valleys pattern, i.e., those of so called "large-patterned", tend to have excellent embossing suitability. In case of separate paper to be provided with Ry of 10.0 to 100.0 μm caused by the given pattern, i.e., the emboss height, the embossing effect is especially achieved high. In the case that the maximum height of the surface figures or hills-and-valleys pattern, namely, the maximum height of given pattern, is of 10.0 μm or shorter, even when the separate sheet having the arithmetical mean roughness Ra of 0.3 μm or smaller is used, differences of the embossing height, the unevenness, and the gloss are slight. If the maximum height is 100.0 μm or higher, the biting of the separable resin layer to the emboss roll becomes too much, so that the separation of the sheet from the emboss roll becomes heavy to lower the productivity owing to the slow down of the speed of the emboss roll.

The pattern of the separate paper according to the first embodiment, second embodiment, third embodiment, or of their combinations is given by placing the separate paper to the position, where the paper being brought into contact with a paper roll, which is a back roll, on the substrate face thereof while it also being brought into contact with the emboss roll bearing the pattern to be formed at the separate layer face thereof, heating to the melting point by heated steam, a heating medium, or an infrared heater in the separate layer, and pressing the sheet by the cooled emboss roll, thereby cooling and forming the emboss pattern to the layer in order to carry out embossing process. On such process, the finely roughened faces are formed, and since the plane portions of the layer to be pressed by the emboss roll is the finely roughened faces, the gas unfortunately entrapped between the separate paper and the emboss roll can be released to leave no un-embossed part and make the depth of the forming pattern approximately same as a prescribed level.

In the present invention, in such a manner, the plane portions of the surface of the separate layer in which the given pattern, that is, the surface figures and the hills-and-valleys pattern, are formed are preferable to have the finely roughened faces with the arithmetical mean roughness Ra of 1.5 to 30.0 μm.

The materials for the substrate and the separate layer, the formation method, the adhesion method, the thickness and the like for the present embodiment are similar to those as the first embodiment, so that their description is eliminated.

The Ra (the arithmetical mean roughness) and the Ry (the maximum height) employed in the present invention are measured by the following methods and the following measuring conditions.

(Measurement Method)

The measurement is carried out according to Japanese Industrial Standards (JIS B 0601-1994), "Surface roughness—definition and display". The following are the international standards corresponding to the standards.

ISO 468—1982 (Surface roughness—Parameters, their values and general rules for specifying requirements)

ISO 3274—1975 (Instruments for the measurement of surface roughness by the profile method—Contact (stylus) instruments of consecutive profile transformation—Contact profile meters, system M)

ISO 4287/1—1984 (Surface roughness—Terminology Part 1: Surface and its parameters)

ISO 4287/2—1984 (Surface roughness—Terminology Part 2: Measurement of Surface roughness parameters)

ISO 4288—1985 (Rules and procedures for the measurement of surface roughness using stylus instruments)

(Measurement Conditions)

The tip radius of a probe: 5 μm

The load: 4 mN

The cut-off value: selected from the standard values disclosed in Table 1

The standard length: selected from the standard values disclosed in Table 2

The measurement apparatus: A surface roughness measurement apparatus Suftest-201 produced by Mitsutoyo Co., Ltd.

TABLE 1

| Range of Ra (μm) | | Cut-off value, | Evaluation length, |
|---|---|---|---|
| more than | Not more than | λc (mm) | ln (mm) |
| (0.006) | 0.02 | 0.08 | 0.4 |
| 0.02 | 0.1 | 0.25 | 1.25 |

TABLE 1-continued

| Range of Ra (μm) | | Cut-off value, | Evaluation length, |
|---|---|---|---|
| more than | Not more than | λc (mm) | ln (mm) |
| 0.1 | 2.0 | 0.8 | 4 |
| 2.0 | 10.0 | 2.5 | 12.5 |
| 10.0 | 80.0 | 8 | 40 |

The number in the parenthesis is a reference value.

TABLE 2

| Range of Ry (μm) | | Standard value, | Evaluation length, |
|---|---|---|---|
| more than | Not more than | l (mm) | ln (mm) |
| (0.025) | 0.10 | 0.08 | 0.4 |
| 0.10 | 0.50 | 0.25 | 1.25 |
| 0.50 | 10.0 | 0.8 | 4 |
| 10.0 | 50.0 | 2.5 | 12.5 |
| 50.0 | 200.0 | 8 | 40 |

The number in the parenthesis is a reference value.

EXAMPLES

Hereinafter, the present invention will be described more particularly according to the following examples.

1. Examples of the First Embodiment

Example 1

A 30 μm-thick layer (separate layer 2) was formed by a melt extrusion coating of a polypropylene (produced by Chisso Corporation) on a Kraft paper (substrate 1) (produced by Kishu Paper Co., Ltd.) with 125 g weight.

Then, an emboss processing apparatus comprising a paper roll and an emboss roll in which a repeated pattern as described below were formed was set so that the emboss roll faced the separate layer 2 of the paper, and then the emboss roll was heated to 120° C. and pressed the paper under the pressure of 60 kg/cm in order to obtain the separate paper 20 having hills-and-valleys pattern.

As the pattern, repeated figures of regular squares as shown in FIG. 2 were formed. One side 6 of each regular square 11 was set so as not to be at right angles to the flow direction of the raw fabric (the application direction 5 of the resin paste) but at acute angles to the direction at the crossing point 15. The diagonal line 71 of each regular square was set to be parallel to the flow direction of the raw fabric (the application direction 5 of the resin paste). Each side of each regular square 11 was set to be 200 μm and the depth was set to have the RT (the maximum height) of 30 μm by the surface roughness.

Synthetic leather was produced using the obtained separate paper. An urethane resin composition for surface skin for the synthetic leather and containing 30% of solid content was applied to the separate layer 2 of separate paper by a knife coating method, dried and stuck to a substrate cloth through an adhesive. The drying ambient temperature was 25° C. and aging was carried out in 20% humidity and the resultant synthetic leather composed of the polyurethane and the substrate cloth was released from the separate layer of the separate paper to obtain synthetic leather with hills-and-valleys patterns.

Example 2

The synthetic leather 20 was produced in the same manner as Example 1, except that repeated figures of diamond shapes 12 as shown in FIG. 3 were formed in place of the repeated figures of regular squares.

One side 6 of each diamond shape was so set as not to be at right angles to the flow direction of the raw fabric and the diagonal line 71 of each diamond shape 12 was set to be parallel to the flow direction of the raw fabric (the application direction of the resin paste). Each side of each diamond shape was set to be 180 μm and the angles were adjusted to be 120° and 60°. The depth was set to have the RT (the maximum height) of 30 μm by the surface roughness.

Example 3

The synthetic leather was produced in the same manner as Example 1, except that repeated figures of regular pentagons as shown in FIG. 4 were formed in place of the regular squares. That is, the patterns were so formed as to satisfying the following: each axially symmetric regular pentagon 13 having the symmetric axis 9 including the apex 8 was positioned as to set it in the rolling out side of the substrate (the starting-side of application) and the symmetric axis 9 including the apex 8 was kept parallel to the flow direction of the raw fabric (the application direction 5 of the resin paste 51). Each side of each regular pentagon was set to be 210 μm and the angle was adjusted to be 120°. The depth was set to have the RT (the maximum height) of 25 μm by the surface roughness.

Comparative Example 1

Figure 6:
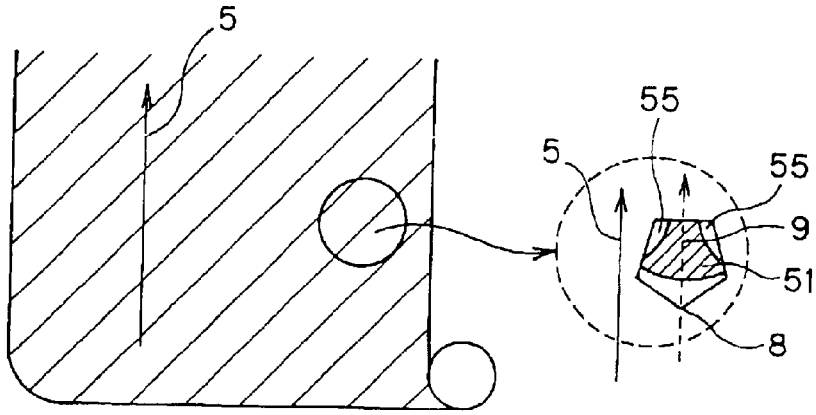
FIG. 6 is a schematic view showing a formation position of a pentagonal figure of another comparative example.

The synthetic leather was produced in the same manner as Example 1, except that one side 6 of each square was set to be parallel to the flow direction of the raw fabric (the application direction 5 of the resin paste) as shown in FIG. 6.

Each side of each regular square was set to be 200 μm and the depth was set to have the RT (the maximum height) of 30 μm by the surface roughness.

Comparative Example 2

The synthetic leather was produced while the apexes 8 of regular pentagons as shown in FIG. 6 being set inversely as those in Example 3, that is, the apexes 8 being kept in the rolling in side (the terminal-side of the application) and the symmetric axes including the apexes 8 being kept parallel to the flow direction of the raw fabric as same those in Example 3. Each side of each regular square was set to be 210 μm and the angle was set to be 120°. The depth was set to have the RT (the maximum height) of 25 μm by the surface roughness.

In respective shapes of Examples 1, 2 and 3, the resin paste 51 was evenly filled in with substantially no inclusion of bubbles, and without any problem on the synthetic leather production, the synthetic leather was obtained while being provided with a uniform repeated pattern having desired polygonal figures.

On the other hand, at the time of the synthetic leather production of Comparative examples 1, 2, the resin paste was unevenly distributed so as to exist only in the center area of each polygon at the position in the application starting-side and consequently, 40% of the produced synthetic leather have defects of the included bubbles 55 around both ends of each the side in the figures and had uneven gloss to result in a low production yield.

2. Examples of the Second Embodiment

Example 4

A 30 μm-thick layer (a separate layer 2) was formed by a melt extrusion coating of a polypropylene (produced by Chisso Corporation) on a Kraft paper (substrate 1) (produced by Kishu Paper Co., Ltd.) with 125 g weight.

Then, an emboss processing apparatus comprising a paper roll and an emboss roll in which a repeated pattern as described below were formed was set so that the emboss roll faced the separate layer 2 of the paper, and then the emboss roll was heated to 120° C. and pressed the paper under the pressure of 60 kg/cm in order to obtain the separate paper 20 having hills-and-valleys pattern.

Figure 7B:
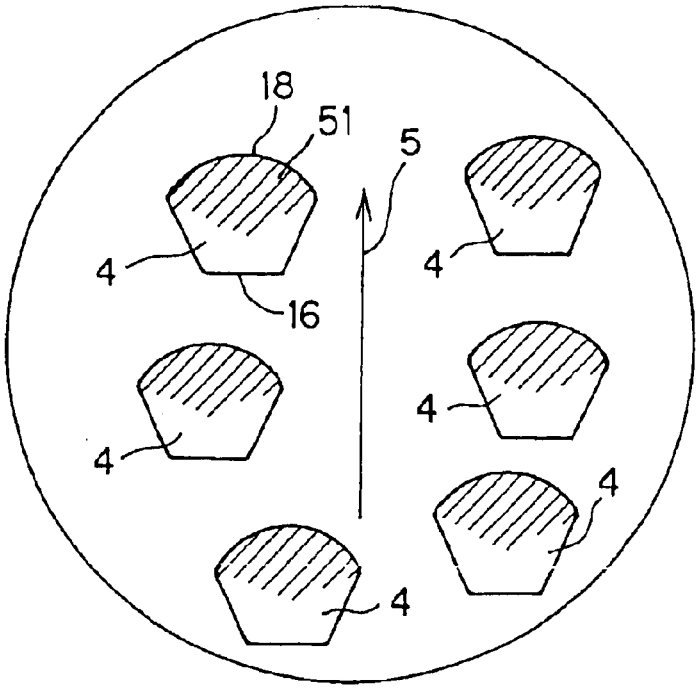

Formed as the pattern was repeated figures of rectangles whose one sides were formed to be out-curved convex curves 18 as shown in FIG. 7(B). The out-curved convex curves 18 of the closed-outline rectangles were adjusted so as to cross the flow direction of the raw fabric (the application direction 5 of the resin paste 51). Each side of each closed-outline FIG. 4 was set to be 200 μm and the depth was set to have the RT (the maximum height) of 20 μm by the surface roughness.

Synthetic leather was produced using the obtained separate paper as follows. An urethane resin composition for surface skin for the synthetic leather and containing 30% of solid content was applied to the separate layer 2 of separate paper 20 by a knife coating method, dried and stuck to the substrate cloth through an adhesive. The drying ambient temperature was 25° C. and aging was carried out in 20% humidity and the resultant synthetic leather composed of the polyurethane and the substrate cloth was released from the separate layer of the separate paper to obtain synthetic leather with hills-and-valleys patterns and free from unevenness of gloss.

Example 5

The synthetic leather 20 was produced in the same manner as Example 1, except that repeated figures of elliptical shapes as shown in FIG. 8(B) were formed in place of the closed-outline figures.

The major axes of the elliptical shapes were set to be 180 μm and the minor axes were set to be 120 μm. The depth was set to have the RT (the maximum height) of 20 μm by the surface roughness. The circumference of each elliptical was so set as to cross the flow direction of the raw fabric in the out-curved convex curve and had no part at right angles to the direction. Consequently, without encountering any resistance parts, the resin paste 51 was filled evenly in the valley parts when applied. As a result, synthetic leather free from uneven gloss can be produced.

Comparative Example 3

The synthetic leather was produced in the same manner as Example 4, except that the out-curved convex curve 18 of each closed-outline FIG. 4 was set so as to be positioned in the application finishing-side in the flow direction of the raw fabric (the application direction 5 of the resin paste 51) as shown in FIG. 10.

Regarding the respective patterns of Examples 4 and 5, the resin paste 51 could be applied without being scarcely accompanied with inclusion of bubbles as shown in FIG. 9 and on the synthetic leather production, synthetic leather having uniform repeated pattern with desired polygonal or elliptical figures was produced without any problems.

On the other hand, in the comparative example 3, the straight line parts 6 of the respective closed-outline figures were at the application starting parts and consequently 40% of the produced synthetic leather have the defects of the included bubbles 55 around both ends of the line as shown in FIG. 10 and had uneven gloss to result in a low production yield.

3. Examples of the Third Embodiment

Example 6

A separate layer (the thickness of 30 μm) was formed by an extrusion coating of a polypropylene (produced by Chisso Corporation) as a polymer for separation on paper SKD (125 g weight) (produced by Kishu Paper Co., Ltd.).

Then, an emboss processing apparatus comprising a paper roll and an emboss roll was set so that the emboss roll faced the separate layer 2 of the paper, and then the emboss roll was heated to 120° C. and pressed the paper under the pressure of 60 kg/cm in order to obtain the separate paper 20 having hills-and-valleys pattern.

Figure 14:
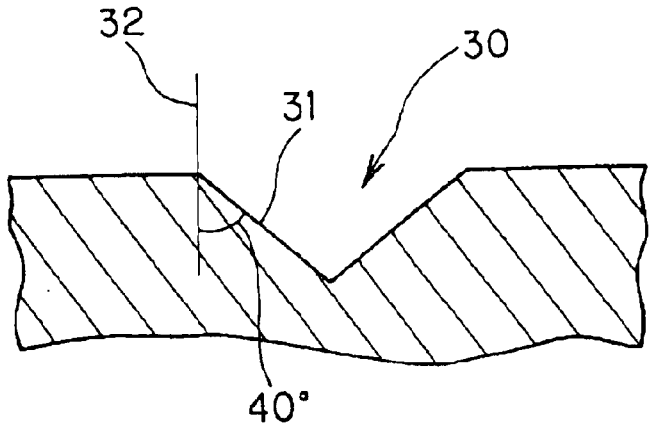
FIG. 14 is a diagrammatic sectional view showing a pattern (valley part) of Example 6 described below.

The emboss pattern were so formed as to have the sectional shapes as shown in FIG. 14. The depth was so adjusted as to keep Rt (the maximum height) 30 μm by the surface roughness and the angles formed between the side faces 31 of each valley part 30 and the perpendicular line 32 of the substrate were set to be 40 degrees. The figures observed as a plan view of the pattern were made to be diamond shapes. Then, synthetic leather was produced using the separate paper produced in the following manner. That is, an urethane resin composition for surface skin of the synthetic leather and containing 30% of solid content was applied to the separate layer of separate paper by a knife coating method, dried and stuck to a substrate cloth through an adhesive and after drying and aging, the synthetic leather was released from the separate paper to obtain the synthetic leather having hills-and-valleys patterns. Ambient conditions of the production were the temperature of 25° C. and the humidity of 20%.

Example 7

Figure 15:
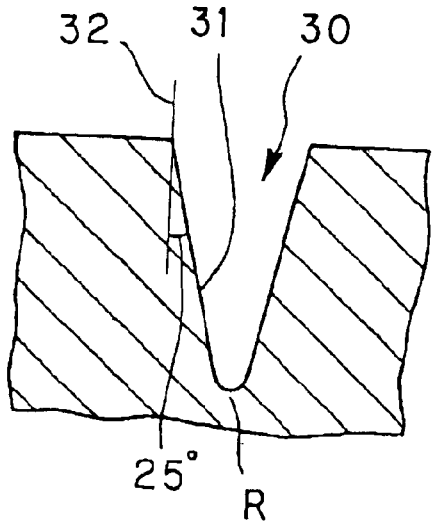
FIG. 15 is a diagrammatic sectional view showing a pattern (valley part) of Example 7 described below.

Only the pattern of Example 6 were changed as follows. That is, the pattern was formed so as to have the sectional shapes as shown in FIG. 15. The depth was so adjusted as to set Rt (the maximum height) to be 25 μm by the surface roughness and the angles formed between the side faces 31 of each valley part 30 and the perpendicular line 32 of the substrate were set to be 25 degrees. The R formed at the crossing point of both side faces of each valley part 30 was set to be 50 μm. The figures observed as a plan view of the pattern were formed to be diamond shapes.

Comparative Example 4

Only the pattern of Example 6 were changed as follows.

Figure 16:
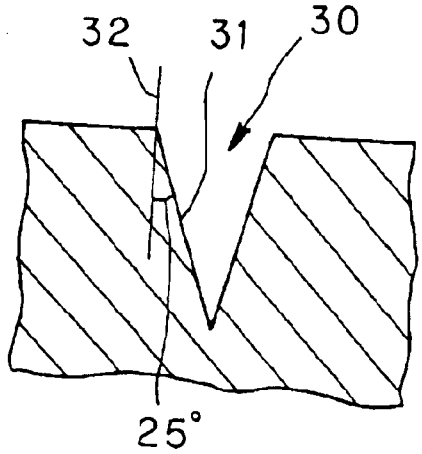
FIG. 16 is a diagrammatic sectional view showing a pattern (valley part) of Comparative example 4 described below.
Figure 17:
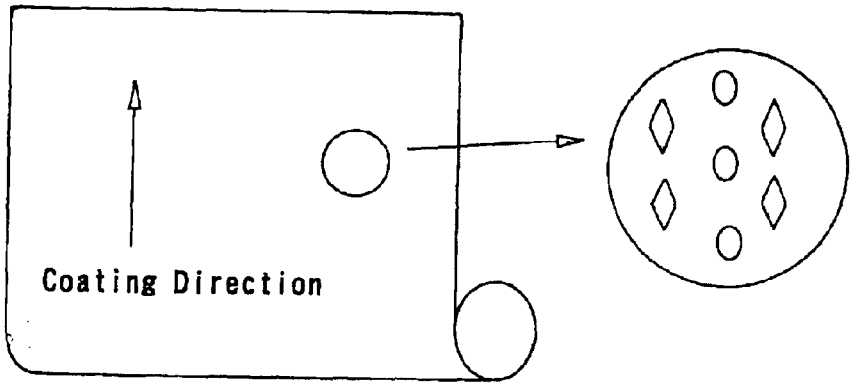
FIG. 17 is a schematic view showing the surface figures of Example 8 described below.

That is, the pattern was so formed as to have the sectional shapes as shown in FIG. 16. The depth was so adjusted as to set Rt (the maximum height) to be 30 μm by the surface roughness and the angles formed between the side faces 31 of each valley part 30 and the perpendicular line 32 of the substrate were set to be 25 degrees. The figures observed as a plan view of the pattern were formed to be diamond shapes.

Regarding Examples 6 and 7, in each figure, substantially no inclusion of bubbles were observed and as a whole there was no problem on the synthetic leather production.

On the other hand, in the comparative example 4, about 40% of the produced synthetic leather contained the defects of bubbles in each figures.

4. Examples of Combinations of the Embodiments and Examples Comprising Plane Portions Having Finely Roughened Faces Example 8

The synthetic leather 20 was produced in the same manner as Example 1, except that the pattern was changed with that having an alternative arrangement of diamond FIG. 12 as shown in FIG. 3 and the elliptical figures as shown in FIG. 8(B).

Example 9

A 30 μm-thick layer (separate layer 2) was formed by a melt extrusion coating of a polypropylene on one side of simile paper (substrate 1) with 52 g/m$^2$ thickness by a T die-type melt extrusion coater comprising a cooling roll having a roughened surface of the arithmetical mean roughness Ra of 1 $\mu$m and finely roughened faces were formed in the surface of the separate layer 2. The finely roughened faces in this case had the arithmetical mean roughness of 0.7 $\mu$m, the cut-off value of 0.8 mm, and the evaluation length of 4 mm.

Figure 18A:
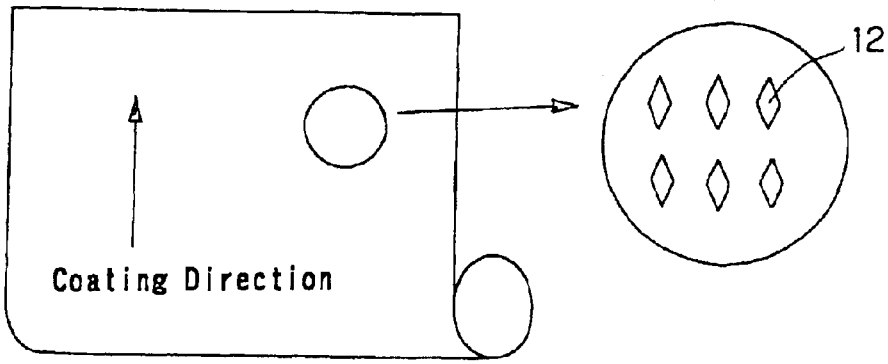
FIG. 18(A) is a schematic view showing the surface figures of Example 9 described below and FIG. 18(B) is a diagrammatic sectional view thereof.
Figure 18B:
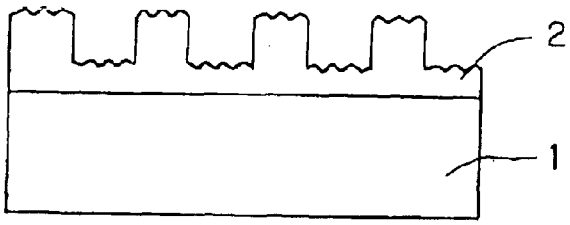

The repeated figures of diamond shapes 12 shown in FIG. 3 were formed using an emboss roll on the finely roughened faces and after that, the same method as Example 1 was carried out to obtain synthetic leather (reference to FIG. 18).

Example 10

Figure 19A:
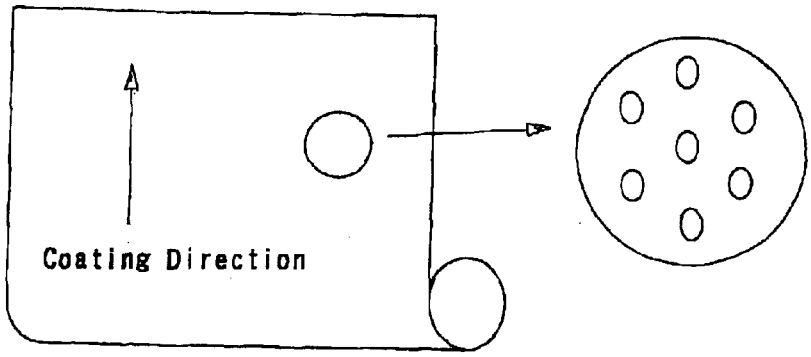
FIG. 19(A) is a schematic view showing the surface figures of Example 10 described below and FIG. 19(B) is a diagrammatic sectional view thereof.
Figure 19B:
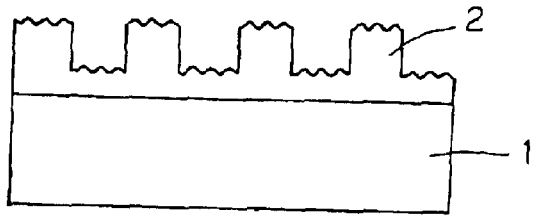

Synthetic leather was produced in the same manner as Example 9 (reference to FIG. 19), except that the pattern was changed to be the repeated figures of ellipsoids shown in FIG. 8(B).

Example 11

Figure 20A:
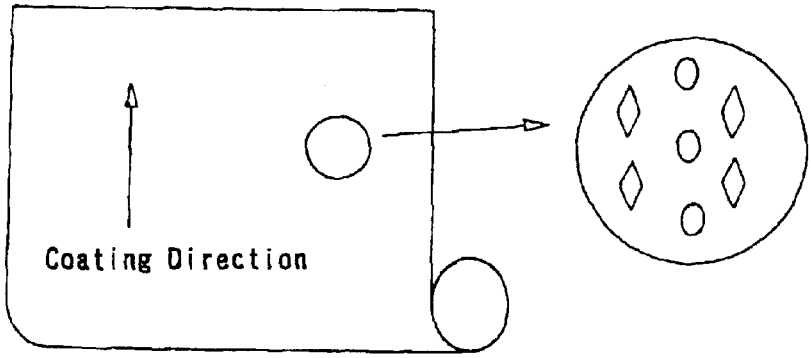
FIG. 20(A) is a schematic view showing the surface figures of Example 11 described below and FIG. 20(B) is a diagrammatic sectional view thereof.
Figure 20B:
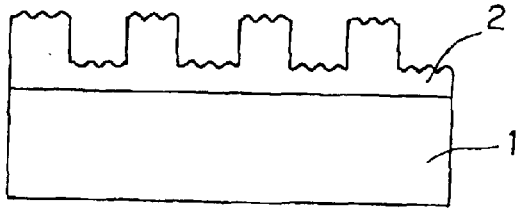

As shown in FIG. 20, synthetic leather was produced in the same manner as Example 9, except that the pattern was changed with that having an alternative arrangement of the diamond FIG. 12 as shown in FIG. 3 and elliptical figures shown in FIG. 8(B).

Example 12

Figure 21:
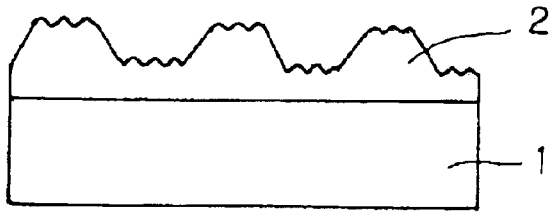
FIG. 21 is a diagrammatic sectional view showing Example 12 described below.

As shown in FIG. 21, synthetic leather was produced in the same manner as Example 9, except that the pattern was changed to be the same as that of Example 6. Incidentally, in this example, flat-bottoms were formed in the individual valley parts.

Example 13

Synthetic leather was produced in the same manner as Example 12, except that only the R of 50 $\mu$m were formed in the crossing points between of the side faces and the flat-bottom of each valley part in the example 12.

Example 14

Figure 22A:
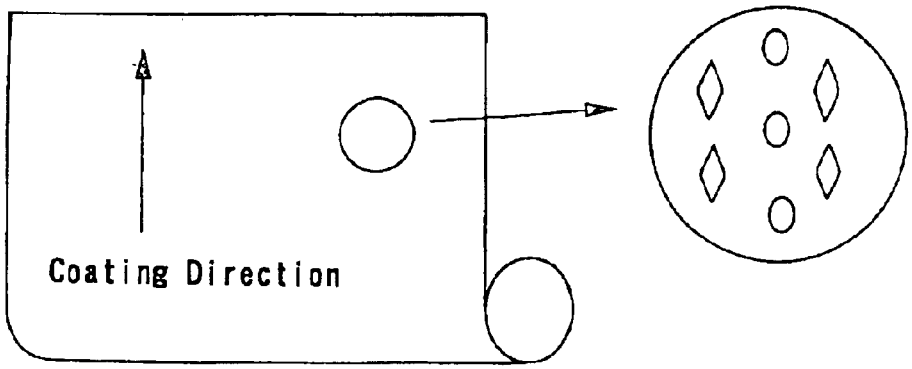
FIG. 22(A) is a schematic view showing the surface figures of Example 14 described below and FIG. 22(B) is a diagrammatic sectional view thereof.
Figure 22B:
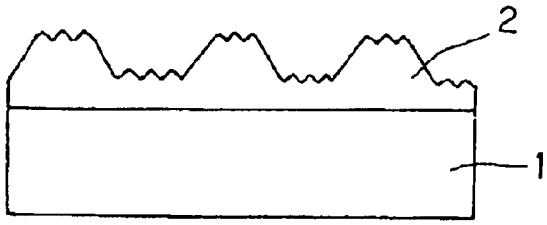

Synthetic leather was produced in the same manner as Example 12, except that the surface pattern was changed to be the same as that of Example 11 as shown in FIG. 22.

Example 15

Figure 23A:
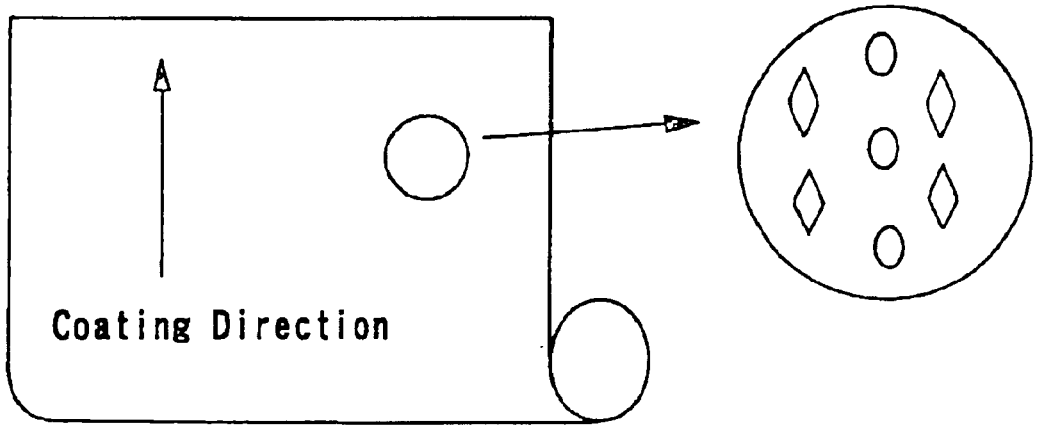
FIG. 23(A) is a schematic view showing the surface figures of Example 15 described below and FIG. 23(B) is a diagrammatic sectional view thereof.
Figure 23B:
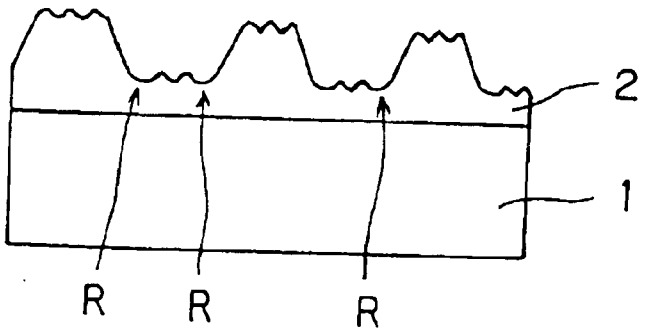

Synthetic leather was produced in the same manner as Example 13, except that the surface pattern was changed to be as that of Example 11 as shown in FIG. 23.

Regarding Examples 8 to 15, in each figures, substantially no inclusion of bubbles was observed and as a whole was no problem on the synthetic leather production. Also, regarding Examples 9 to 15, the obtained synthetic leather was more excellent in the depth of the hills-and-valleys patterns, the uniformity of the surface, and the gloss of the surface.

What is claimed is:

1. Separate paper for a process comprising a substrate and a separate layer formed in at last one side of the substrate, wherein a surface of said separate layer has polygonal shaped figures which are as a combination thereof a surface view of a repeated hills-and-valleys pattern of said separate layer, and at least one side of each said polygon is set so as to be at an acute angle to the longitudinal direction of the paper.

2. The separate paper for a process according to claim 1, wherein said polygonal shaped figures which are as the combination thereof a surface view of the repeated embossed pattern of the separate layer are (2+2n)-gonal shaped figures (wherein n denotes a natural number), and wherein at least one diagonal line of each said polygon is parallel to the longitudinal direction of the paper.

3. The separate paper for a process according to claim 1, wherein said polygonal shaped figures which are a combination thereof a surface view of the repeated hills-and-valleys pattern of the separate layer are (1+2n)-gonal shaped figures (wherein n denotes a natural number), and each possesses an axial symmetry with the symmetric axis which has an apex of the polygon, and said symmetric axis is parallel to the longitudinal direction of the paper and the apex is positioned at the traveling starting-side in the polygon.

4. The separate paper for a process according to claim 1; wherein said separate layer has a combination of polygons enumerated in claims 2 and 3.

5. Separate paper for a process comprising a substrate and a separate layer formed in at least one side of the substrate, wherein a surface of said separate layer has a combination of closed-outline figures which is a surface view of a repeated hills-and-valleys pattern of the separate layer, wherein a curved-line portion of all the closed-outline figure is an cut-curved convex curve and crosses the longitudinal direction of the paper.

6. The separate paper for a process according to any one of claims 1, 2, 3 or 5, wherein a plane portion of the surface of said separate layer is a finely roughened face having an arithmetical mean roughness Ra of 1.5 to 30.0 $\mu$m.

7. The separate paper for a process according to claim 6, wherein the figures or the hills-and-valleys pattern of the separate layer have a Ry of 10.0 to 100.0 $\mu$m.

8. The separate paper for a process according to claim 4, wherein a plane portion of the surface of said separate layer is a finely roughened face having an arithmetical mean roughness Ra of 1.5 to 30.0 $\mu$m.

9. The separate paper for a process according to claim 8, wherein the figures or the hills-and-valleys pattern of the separate layer have a Ry of 10.0 to 100.0 $\mu$m.

10. The separate paper for a process according to claim 1 or 5, wherein the side faces of each valley part in the hills-and-valleys pattern of the separate layer are at an angle of 30 degrees or higher to the perpendicular line of the substrate.

11. The separate paper for a process according to claim 10, wherein a plane portion of the surface of said separate layer is a finely roughened face having an arithmetical mean roughness Ra of 1.5 to 30.0 $\mu$m.

12. The separate paper for a process according to claim 11, wherein the figures or the hills-and-valleys pattern of the separate layer have a Ry of 10.0 to 100.0 $\mu$m.

13. The separate paper for a process according to claim 1 or 5, wherein the side faces of each valley part in the hills-and-valleys pattern of the separate layer are at an angle of 0 degrees or higher to the to the perpendicular line of the substrate and wherein the crossing portions of the side faces and a bottom face in the valley part art radiused.

14. The separate paper for a process according to claim 13, wherein the radiused portions have 50 $\mu$m or longer radius.

15. The separate paper for a process according to claim 13, wherein a plane portion of the surface of said separate layer is a finely roughened face having an arithmetical mean roughness Ra of 1.5 to 30.0 $\mu$m.

16. The separate paper for a process according to claim 15, wherein the figures or the hills-and-valleys pattern the separate layer have a Ry of 10.0 to 100.0 $\mu$m.

* * * * *